US005161490A

United States Patent [19]

Iwata et al.

[11] Patent Number: 5,161,490

[45] Date of Patent: Nov. 10, 1992

[54] AIR-COOLED INTERNAL COMBUSTION ENGINE

[75] Inventors: Mitsunori Iwata; Kazuto Usui; Junich Samo, all of Osaka, Japan

[73] Assignee: Yanmar Diesel Engine Co., Ltd., Osaka, Japan

[21] Appl. No.: 644,774

[22] Filed: Jan. 23, 1991

[30] Foreign Application Priority Data

Jan. 29, 1990 [JP] Japan ..... 2-20095

[51] Int. Cl.[5] ..... F01P 1/02

[52] U.S. Cl. ..... 123/41.7; 123/195 A; 123/198 R

[58] Field of Search ..... 123/41.56, 41.63, 41.65, 123/41.69, 41.7, 52 M, 195 A, 198 R, 198 L, 198 E, 509, 195 HC; 60/317, 320, 321

[56] References Cited

U.S. PATENT DOCUMENTS 3,782,344 1/1974 Schmuck ..... 123/41.7
4,438,733 3/1984 Sasaki ..... 123/198 E
4,483,279 11/1984 Köhler et al. ..... 123/41.65
4,494,490 1/1985 Kiyooka et al. ..... 123/41.56
4,790,273 12/1988 Oguri et al. ..... 123/195 HC

FOREIGN PATENT DOCUMENTS 63-20821 6/1988 Japan .

*Primary Examiner*—Noah P. Kamen
*Attorney, Agent, or Firm*—Armstrong & Kubovcik

[57] ABSTRACT

An air-cooled internal combustion engine and a structure of its air cleaner, a major object of which is to control noises emitted from various parts of engine and to minimize the overall size and dimensions of the engine. A cam shaft and a balancing shaft are arranged on an air cleaner side relative to a crank-shaft, a starting motor is arranged on an exhaust muffler side relative to the crank-shaft, shaft portions of the balancing shaft and the starting motor are located at a position lower than the crank shaft, and the exhaust muffler is arranged vertically above the starting motor, so that a center of gravity of the entire engine is lowered and engine noise can be controlled. Further, noises emitted from various parts of engine are controlled by positioning and shaping of an exhaust pipe, a shape of a cylinder head cover, and an arrangement and position of a fuel tank.

6 Claims, 7 Drawing Sheets

AIR-COOLED INTERNAL COMBUSTION ENGINE

BACKGROUND OF THE INVENTION

1. Field of the Invention

This invention relates to an air-cooled internal combustion engine.

2. Description of the Related Art

Conventional internal combustion engines of the type to which the present invention is directed include the following problems:

(1) A cam shaft and a balancing shaft are arranged separately on the left and right sides of a crank-shaft, and a heavy starting motor is positioned above the crank-shaft at the balancing shaft side of the crankshaft. Consequently, the engine has a high center of gravity, a large overall engine height, and an objectionable vibration noise sound level.

(2) As for a cooling structure, in Japanese unexamined Utility Model Publication No. 63-20821 for example, an air cleaner is disposed on the same side as a fan cover and cooling air sent from a cooling fan into a cylinder head is exhausted and dispersed in different directions, so that it is difficult to collect exhausted air into one spot. Therefore, it becomes difficult and requires a complicated arrangement to provide an exhaust air disposal mechanism when mounting such an engine on an operation machine.

(3) In the Japanese unexamined Utility Model Publication No. 63-20821, an exhaust muffler is connected to an exhaust port through a simple exhaust pipe and counter-measures against noise are not taken.

(4) The fuel injection valve is also not covered by a cylinder head cover so that a problem results due to noise emitted from around the fuel injection nozzle.

(5) The fuel tank is also supported directly on the engine body. Therefore, vibration-proof members should be attached to all supporting parts and this makes the supporting mechanism complicated.

(6) Also, with respect to the position of the air cleaner or the position of the air cleaner relative to the fuel injection pump, the air cleaner is not utilized as a means for reducing noise.

OBJECTS OF THE INVENTION

In an air-cooled internal combustion engine, an object of the present invention is to control vibrations of the entire engine and to make the overall engine dimensions small by devising and utilizing novel arrangements of respective shafts.

A further object of the present invention is to reduce exhaust air noise by providing for collection of exhausted cooling air and to simplify an exhaust air disposal mechanism for an air-cooled internal combustion engine when mounted for operating a machine.

A still further object of the invention is to reduce exhaust noise by providing a novel shape and location of an exhaust pipe connecting an exhaust muffler to an exhaust port.

Another object of the present invention is to cut off noise of a fuel injection valve and to positively cool the fuel injection valve by providing a novel shape of a cylinder head cover.

A still further object of the present invention is to simplify a fuel tank supporting mechanism and to reduce vibration noise by providing a novel arrangement and location of the fuel tank.

A stiff further object of the present invention is to separate hot air around an engine from cold air by providing a novel shape of a fitting surface of a cooling fan case to be fit to an engine body.

Further objects of the present invention are to further reduce the above-mentioned noises by a novel arrangement of an air cleaner.

SUMMARY OF THE INVENTION

The present invention is directed to an air-cooled internal combustion engine which includes an exhaust muffler 10 and an air cleaner 9 arranged separately on the left and right sides of an engine body as viewed from a power take-out side in a longitudinal direction of the crank-shaft, a cooling fan 17 and a fan case 18 installed on a side of the engine opposite to the power take-out, and a fuel tank 19 installed at an upper part of the fan case 18. In one preferred embodiment of the invention, a cam shaft 14 and a balancing shaft 13 are arranged on the air cleaner side in the engine body relative to a crank-shaft 12, a starting motor 29 is arranged on a side face of the engine body at the exhaust muffler side relative to the crank-shaft 12, the balancing shaft 13 and a shaft portion of the starting motor 29 are located at a position lower than the crank-shaft 12, and the exhaust muffler 10 is arranged at a higher position relative to the starting motor 29. The foregoing arrangement and relative locations of component parts of the engine assembly provide for a lower center of gravity of the entire engine, better control of engine vibration, and a reduction in the overall size and dimensions of the engine.

In a further embodiment of the invention, a cooling air passage 33 is formed in a cylinder head 7 and enables cooling air to flow only from the cooling fan side to the power take-out side; a cooling air passage 32 is formed in cylinder 2 and enables cooling air to flow only from the cooling fan side to the power take-out side; an exhaust air flange 38 is formed on the power take-out side cooling air outlets of the cylinder head 7 and the cylinder 2 and surrounds them; and an exhaust air duct 59 or an exhaust air guide 42 is made attachable to and detachable from the exhaust air flange 38. By this structure, cooling air from the cooling fan 17 can flow in one direction through the head-side cooling air passage 33 and the cylinder-side cooling air passage 32 to the power take-out side, so that disposal of the exhausted cooling air becomes simple.

In a still further embodiment of the invention, an exhaust port 34 of the cylinder head 7 is opened to the power take-out side, and a primary expansion chamber in combination with an exhaust pipe 41, which covers the power take-out side of the cylinder head 7 and the cylinder head 2, is formed on the exhaust muffler 10 to be connected to the above-mentioned exhaust port 34. Exhaust noise is reduced by this structure, and noise emitted from the cylinder 2 is cut off by surrounding four sides of the cylinder 2.

In another embodiment of the invention, the cooling air passage 33 which permits cooling air to flow from the cooling fan side to the power take-out side, is formed in the cylinder head 7, a fuel injection valve chamber 46 isolated from a rocker arm chamber 47 is integrally formed in a cylinder head cover 8 which is fastened to an upper part of the cylinder head 7, a cooling fan side end of the fuel injection valve chamber 46 is connected to an upstream side of the head-side cooling air passage 33 through a cooling air intake port **49*a* of a cylinder head upper wall, and an end portion of power take-out side of the fuel injection valve chamber 46 is connected to a downstream side of the head-side cooling air passage 33 through a cooling air outlet port 49***b* of the cylinder head upper wall. With this arrangement, the fuel injection valve 43 can be positively cooled and emission sound from the fuel injection valve 43 can be cut off.

In a further embodiment of the invention, a fuel tank 19 is formed with shape that covers an upper part of the fan case 18, the fan case 18 is supported through a vibration proof damper member 66 to an engine body, an upper end of the fuel tank 19 is supported through a vibration proof damper member 63 to the cylinder head 7, a lower end of the fuel tank is secured to the fan case 18 without vibration damping means, and a vibration absorbing member 64 is held between the fuel tank 19 and the fan case 18. A simplified vibration-proof supporting mechanism of the fuel tank 19 is provided by this structure.

In a still further embodiment of the invention, a fan case fitting surface 53 is made to fit over fitting planes of the cylinder head 7, the cylinder 2 and the crank-case 3; the exhaust muffler 10 and the air cleaner 9 are located at positions removed from the fan case fitting surface 53 toward the power take-out side of the engine; and a partition plate 58 is provided between the fan case fitting surface 53 and a fan case flange of the engine body; so that a space occupied by an engine assembly includes a fan case side space and a space housing the engine body, the exhaust muffler 10 and the air cleaner 9. With this structure, a portion of the engine having high temperature is separated from a portion of the engine having a low temperature.

In another embodiment of the invention, a fuel injection pump 112 is arranged on an intake passage inlet 111*a* side of the cylinder head 7, the air cleaner 9 is so arranged in front of the intake passage inlet 111*a* when viewed from the intake passage inlet side, so that an intake passage outlet of the air cleaner 9 is connected to the intake passage inlet 111*a* of the cylinder 7, and the fuel injection pump 112 is located at a position lower than the intake passage inlet 111*a* of the cylinder head between the cylinder head 7 and an air cleaner body 116. With this structure, the air cleaner body 116 absorbs intake noise produced at the intake passage 111 of the cylinder head 7, and cuts off noises emitted from the cylinder head 7, the cylinder 2 and the fuel injection pump 112.

In a still further embodiment of the invention, a novel air suction pipe formed integrally with the air cleaner body 116 of the air cleaner 9 is provided between an air cleaner fitting surface 114 of the cylinder head 7 and the air cleaner body 116. The air cleaner body 116 absorbs suction noise produced at the intake passage in the cylinder head. Further, a service life of the element is prolonged since it is more difficult to directly suck atmospheric air and dust from the novel air suction pipe.

DESCRIPTION OF THE PREFERRED EMBODIMENT

Figure 1:
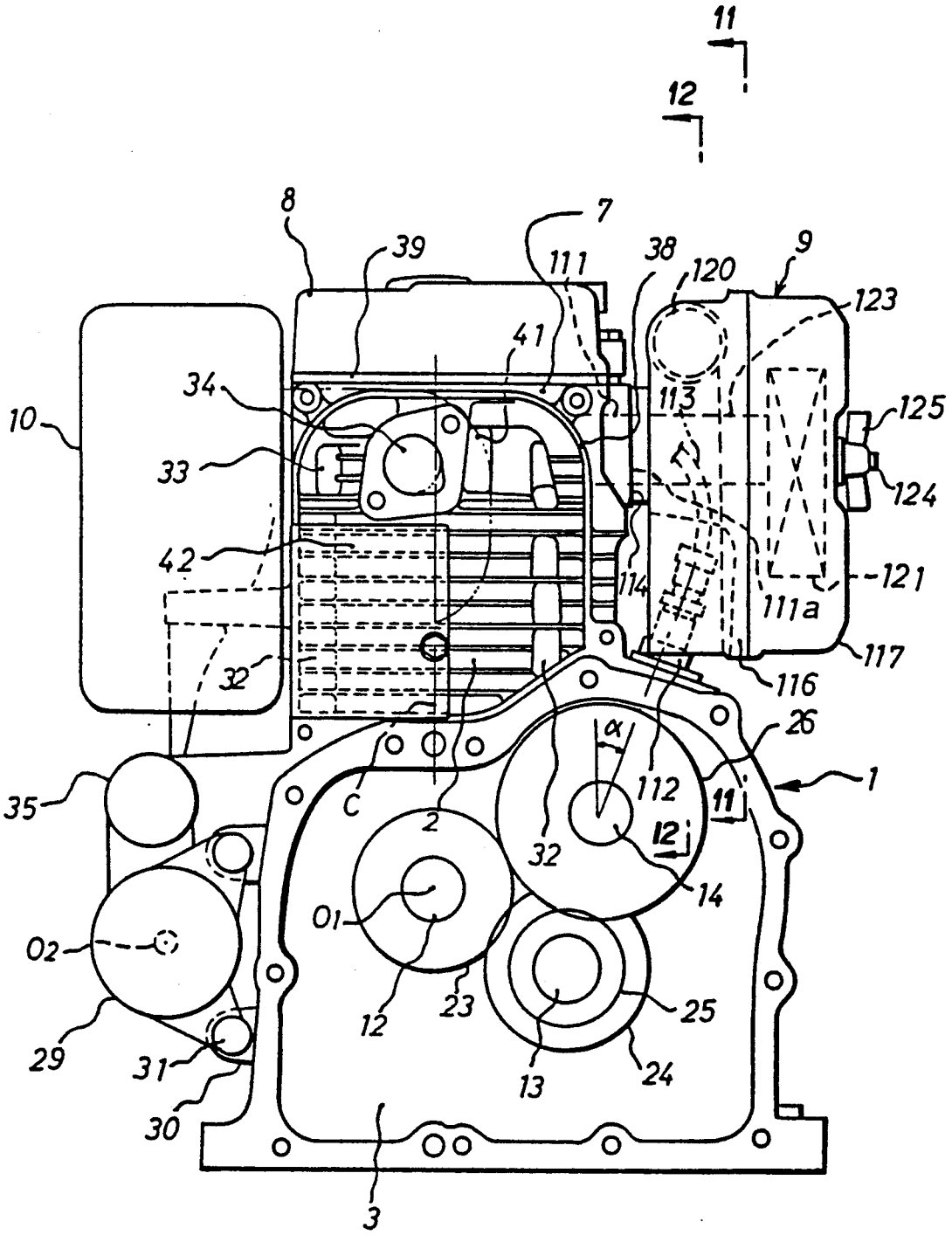
FIG. 1 is a front view of the air-cooled internal combustion engine of the present invention.

FIGS. 1 through 10 show a horizontal type air-cooled internal combustion engine comprising a first embodiment of the present invention. In FIG. 1 which illustrates a front view of the engine as viewed from the power take-out side in a longitudinal direction of the crank-shaft, an engine body is composed of a cylinder block 1 and a cylinder head 7 etc., and the cylinder block 1 integrally includes a cylinder 2 and a crank-case 3. An air cleaner 9 is arranged on a right side of the cylinder 2 and the exhaust muffler 10 is arranged on its left side, and a cylinder head cover 8 is secured to a top surface of the cylinder head 7.

A horizontal crank-shaft 12 is supported in the crank-case 3 within a vertical plane common with a cylinder center line C. The balancing shaft and the cam shaft 14 are arranged on the air cleaner side (right side) of crank-shaft 12 in the crank-case 3, and a starting motor 29 is arranged at a side of the crank-case on the exhaust muffler side (left side). The cam shaft 14 is located at a position higher than the crank-shaft 12 and shaft portions of both a balancing shaft 13 and the starting motor 29 are located at positions lower than the crank-shaft 12, so that the vertical location of the center of gravity of the entire engine can be made small. The starting motor 29 and an upper solenoid are fastened to brackets 30 formed on the crank-case 3 by bolts 31. The above-mentioned exhaust muffler 10 is vertically installed above the starting motor 29.

At the power take-out side of the crank-case 3, the balancing shaft 13 is equipped with a balancing shaft driven gear 24 and a cam shaft driving gear 25. The balancing shaft driven gear 24 meshes with a gear 23 of the crankshaft 12 and the cam shaft driving gear 25 meshes with a cam gear 26, so that the cam shaft 14 can be rotated in the same direction of rotation as the crank-shaft 12.

A cylinder-side cooling air passage 32 is formed around the cylinder 2 which allows cooling air to flow only from a cooling fan side which is opposite to the power take out side to the power take-out side of the engine. A head-side cooling air passage 33 which allows cooling air to flow only from the cooling fan side which is opposite to the power take-out side to the power take-out side and an exhaust port 34 of the cylinder head 7 opens to the power take-out side. A primary expansion chamber is provided in combination with exhaust pipe 41, which is formed lengthwise in a vertical direction to cover the power take-out sides of the cylinder head 7 and the cylinder 2. The exhaust pipe 41 is formed on the exhaust muffler 10 for connection to the exhaust port 34.

An exhaust air flange 38 is formed around the power take-out sides of the cylinder head 7 and the cylinder 2 and surrounds both of the cooling air passages 32 and 33. An exhaust air guide 42 is fastened by a bolt to the exhaust air flange 38 in the engine as shown by FIG. 1.

Figure 2:
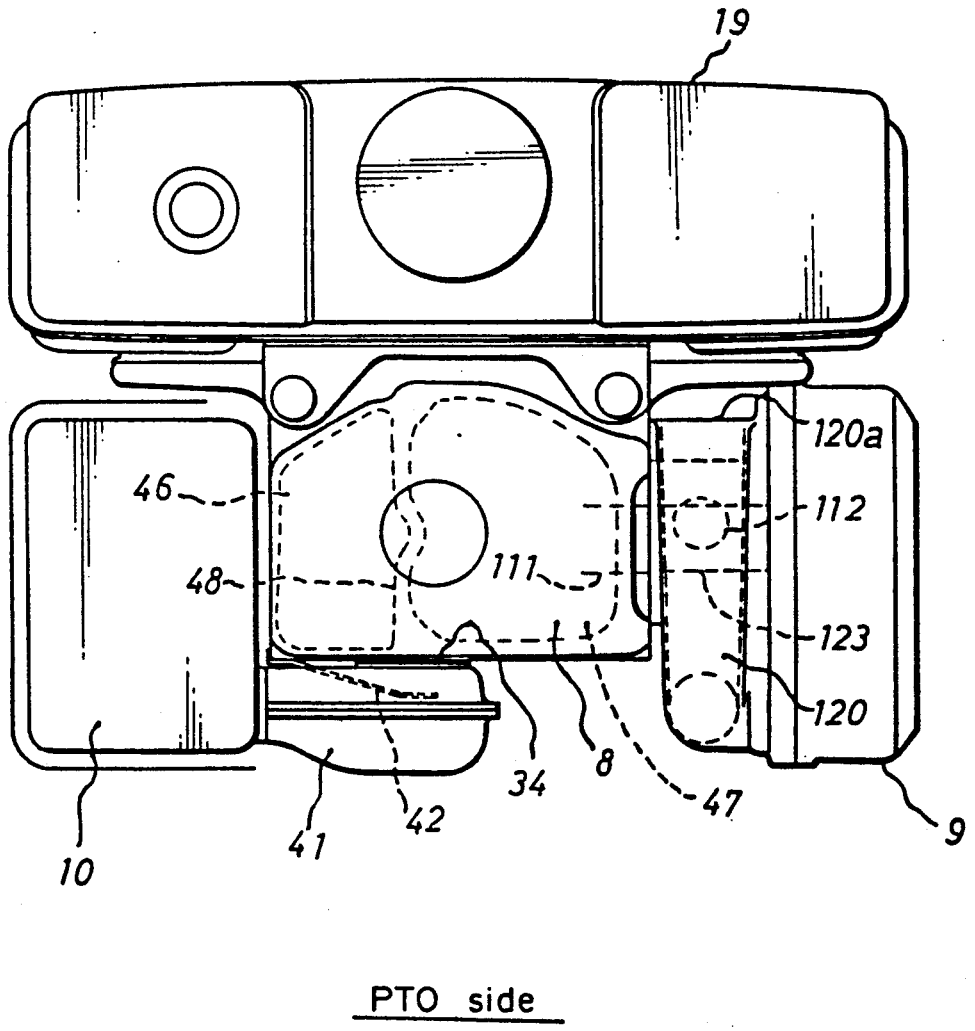
FIG. 2 is a plan view of the engine of FIG. 1.

In FIG. 2, a fuel tank 19 is installed on the side opposite to the power take-out side, and the fuel tank 19 extends in a lateral direction from one end of the exhaust muffler 10 to an opposite end of the air cleaner. Thus, four sides of the cylinder 2 are surrounded by the fuel tank 19, the air cleaner 9, the exhaust muffler 10 and the primary expansion chamber in combination with exhaust pipe 41.

Figure 3:
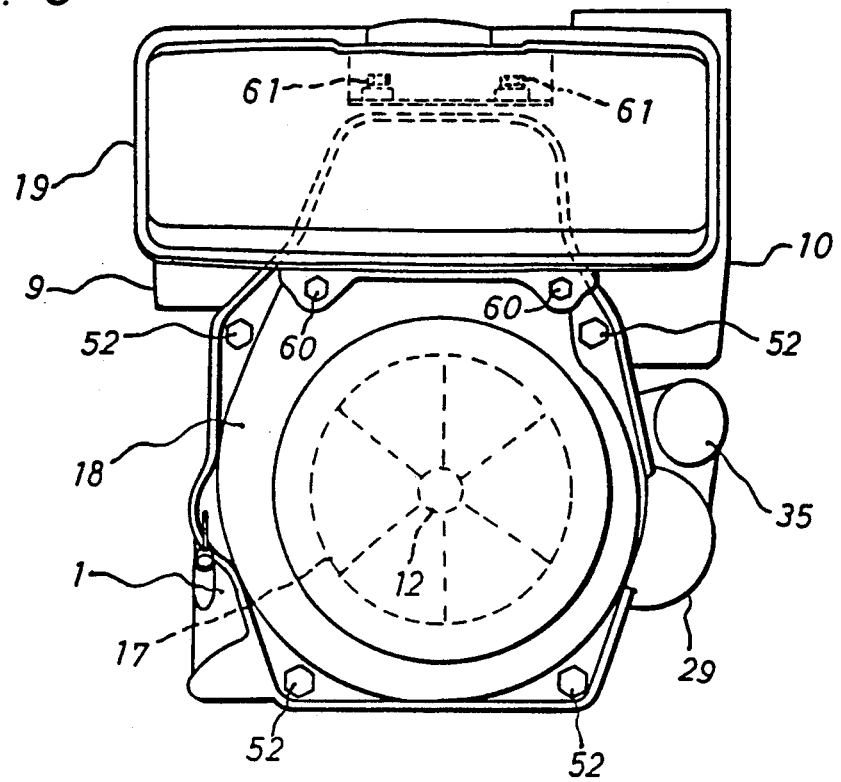
FIG. 3 is a rear view of the engine of FIG. 1.

With reference to FIG. 3, a cooling fan 17 and a fan cover 18 covering the cooling fan are installed on the side opposite to the power take-out side. The fuel tank 19 is installed on an upper part of the fan cover 18.

Figure 4:
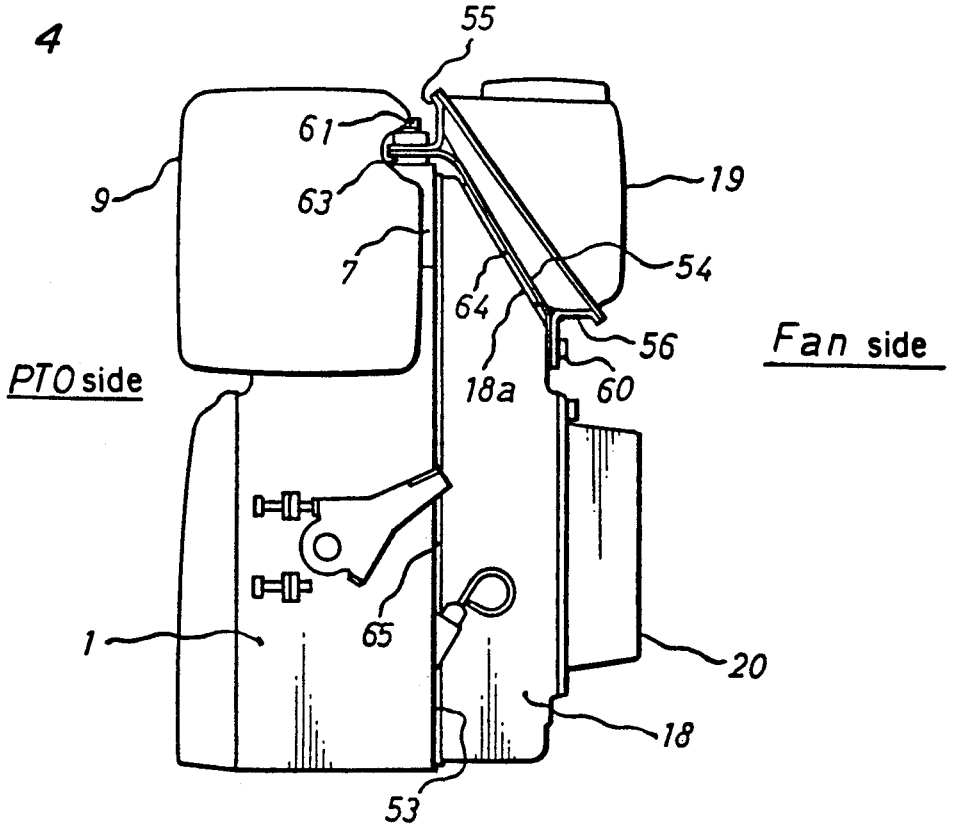
FIG. 4 is a right side view of the engine of FIG. 1.
Figure 8:
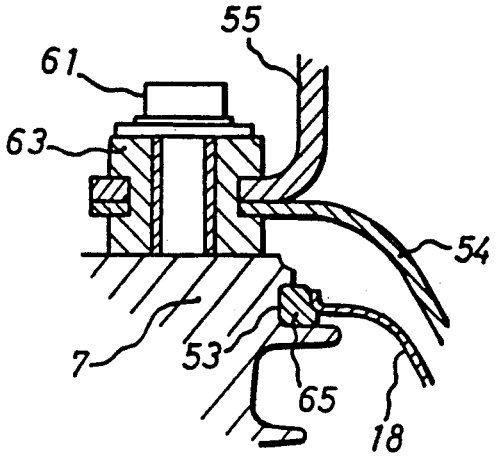
FIG. 8 is an enlarged vertical sectional view of an upper fitting portion of a fuel tank.

In FIG. 4, fan cover fitting surfaces 53 for the cylinder block 1 and the cylinder head 7 are shown to be made flush in the same vertical plane, and the fan cover 18 is fitted to the fitting surfaces 53 with a seal 65. An upper part of the fan cover 18 is formed into an inclined face 18*a*, and an attaching plate 54 of the fuel tank 19 is mounted on the inclined face 18*a* with a vibration absorbing member 64 held between them. Upper and lower brackets 55 and 56 are provided on upper and lower ends of the attaching plate 54 respectively. The lower bracket 56 is secured to a side face of the fan cover 18 together with the lower end of the attaching plate 54 without using a vibration-proof mechanism, and the upper bracket 55 is flexibly mounted on the upper end of the cylinder head 7 through a vibration-proof rubber 63 together with the attaching plate upper part and secured by a bolt 61 as illustrated in FIG. 8.

Figure 9:
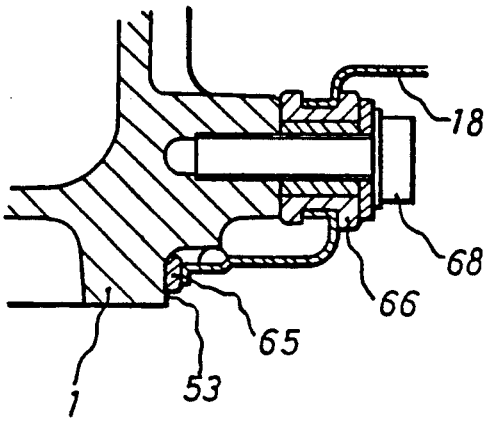
FIG. 9 is a vertical sectional view of an upper fitting portion of a fan case.

The fan cover 18 itself is resiliently mounted on the cylinder block 1 through a vibration-proof damper 66 and is secured thereto by a bolt 68 as illustrated in FIG. 9.

Figure 5:
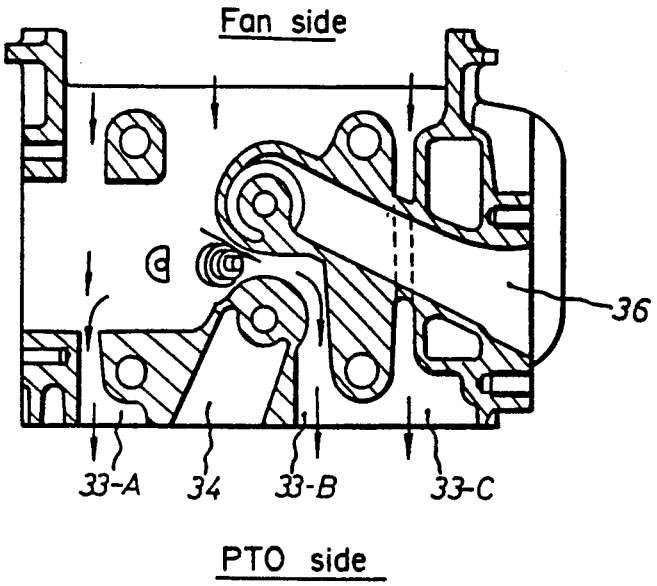
FIG. 5 is a horizontal sectional view of a cylinder head.

In FIG. 5, which shows a horizontal sectional view of the cylinder head 7, the head-side cooling air passage 33 is divided into three branch passages 33-A, 33-B and 33-C all of which are formed to allow cooling air to flow only in a direction from the cooling fan side to the power take-out side of the engine. 36 is a suction port.

Figure 6:
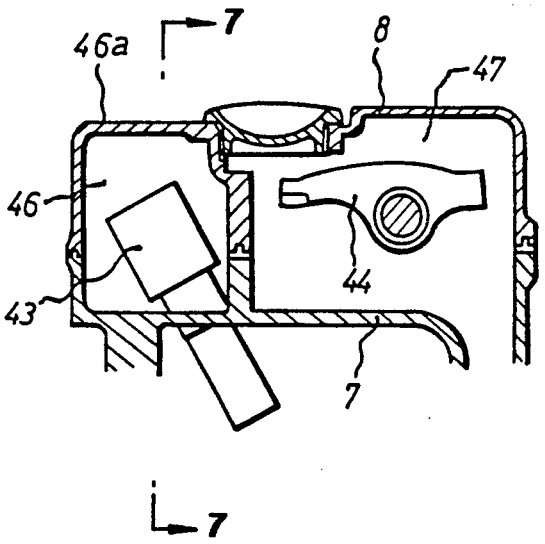
FIG. 6 is a vertical sectional view view of a cylinder head cover.

FIG. 6 shows a vertical sectional view of the cylinder head cover 8, and a fuel injection valve chamber 46, which is partitioned from a rocker arm chamber 47 housing a rocker arm 44 and includes a closing or covering wall 46*a* integrally formed as part of the cylinder head cover 8.

Figure 7:
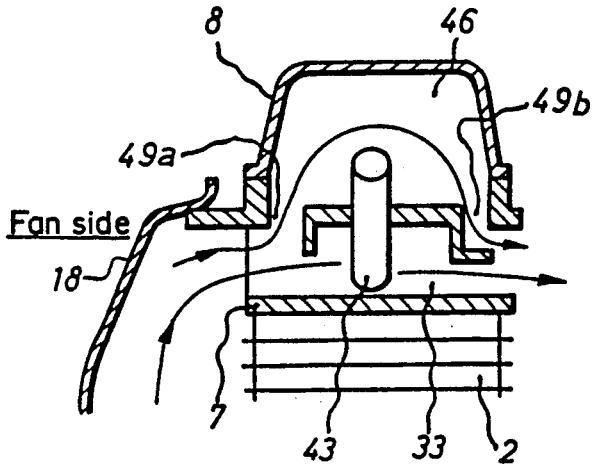
FIG. 7 is a sectional view taken on a line 7—7 of FIG. 6.

In FIG. 7, which shows a section taken on the line 7—7 of FIG. 6; a cooling air intake port 49*a*, which connects the fan-side end of the fuel injection valve chamber 46 to the fan-side end of the head-side cooling air passage 33, is formed on an upper wall of the cylinder head. A cooling air outlet port 49*b* which connects the power take-out end of the fuel injection valve chamber 46 to the power take-out side end of the head-side cooling air passage 33, is also formed on the cylinder head upper wall. With this arrangement a part of the cylinder head cooling air is induced to flow through the fuel injection valve chamber 46 and positively cool the fuel injection valve 43.

A flow pattern of cooling air will now be described. Cooling air sucked by the cooling fan 17 from outside flows from the fan cover 18 into the cylinder 2 and the passages 32 and 33 of the cylinder head 7, and a part of the cooling air in the cylinder head 7 further flows into the fuel injection valve chamber 46 of the cylinder head cover 8 to cool the cylinder 2, the cylinder head 7 and the fuel injection valve 43 respectively. Each of these flows of cooling air are exhausted from the power take-out side. In a case where the exhaust guide 42 is attached to the exhaust air flange 38 as illustrated by FIG. 1, exhausted cooling air is further guided by the exhaust guide 42.

Figure 10:
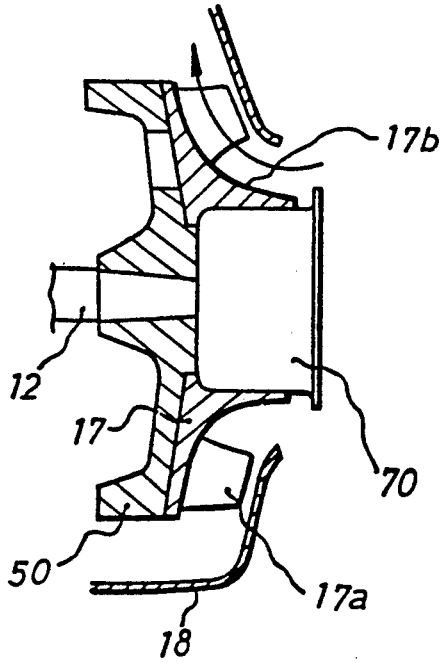
FIG. 10 is a vertical sectional view of a cooling fan.

In FIG. 10, the cooling fan 17 is made of resin independently from a flywheel 50, and the cooling fan 17 closely contacts an outer periphery of a starting pulley 70 secured to the flywheel 50. Cooling air is sucked by the cooling fan 17 from outside in an axial direction. The outer periphery of the cooling fan around the starting pulley 70 is formed into a curved shape adapted to the low of cooling air as shown by 17*b*.

Since the independent resin-made fan 17 is made to closely contact the outer periphery of the starting pulley 70; vibration of the starting pulley 70 can be controlled, the shape of the fan for adapting the flow of cooling air can be formed easily, and the volumetric flow of cooling air can be increased. Further, the flow pattern of cooling air can be smoothly adapted so that fan noise produced by fan blades 17*a* can be reduced, and weight-reduction such as drilling, etc. of the flywheel 50 can be accomplished without reducing the volumetric flow of cooling air by forming the cooling fan 17 separately from the flywheel 50.

Structures of the air cleaner 9, a fuel injection pump 112 and an intake passage 111 etc. will now be described in detail. In FIG. 1; the intake passage 111 opens to the right side of FIG. 1, and the fuel injection pump 112 is installed on an intake passage inlet 111*a* side and is mounted on the crank-case 3. The fuel injection pump 112 is mounted at a small angle (20° for example) in relation to the cylinder center line, and the fuel injection pump 112 is connected to a fuel injection valve 43 (FIG. 6) by a fuel pipe 113.

The air cleaner 9 installed on the fuel injection pump side (right side) of the cylinder head 7 is formed in such a large shape and a large capacity as to cover approximately all of the surfaces of the intake passage inlet sides of the cylinder head 7 and the cylinder 2.

The air cleaner 9 includes an air cleaner body 116 and an air cleaner cap 117. The air cleaner body 116 is spaced apart from an air cleaner fitting surface 114 of the cylinder head 3 by a specified distance. The above-mentioned fuel injection pump 112 is located at a position lower than the intake passage inlet 111*a* between the air cleaner body 116 and the air cleaner fitting surface 114. An air cleaner side intake passage pipe 123 is integrally formed by resin on the air cleaner body 116 and extends to the cylinder head side. The intake passage pipe 123 is secured by bolts (not shown) to the air cleaner fitting surface 114 and thus connected to the inlet 111*a* of the intake passage 111 of the cylinder head 7. A novel air suction pipe 120 is formed by resin integrally with the air cleaner body 116 on a cylinder head side surface of the air cleaner body 116.

The air cleaner cap 117 is fitted to the air cleaner body 116 in a detachable manner by a fitting bolt 124 and a butterfly nut 125. A filter element 121 is installed inside the air cleaner cap 117.

Figure 11:
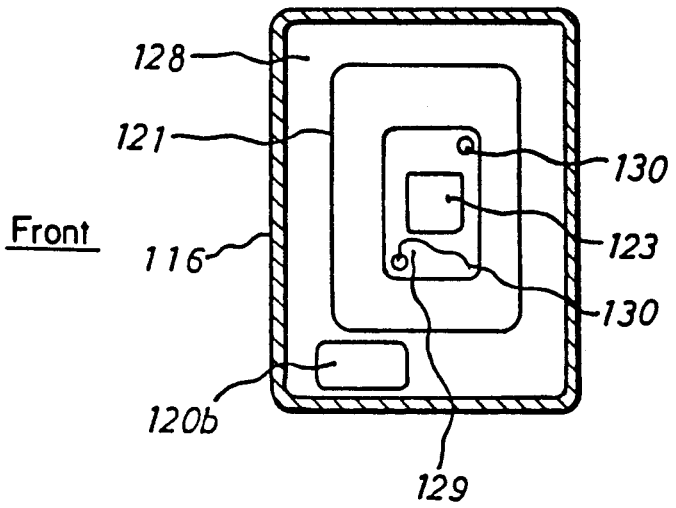
FIG. 11 and FIG. 12 are sectional views taken on lines 11—11 and 12—12 of an air cleaner as shown by FIG. 1.
Figure 12:
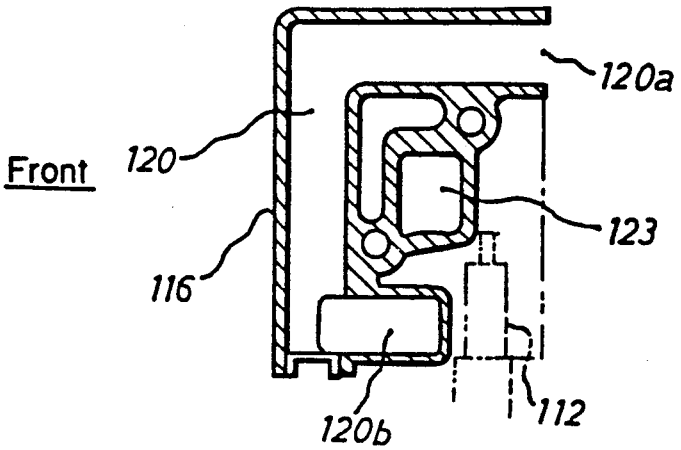

In FIG. 12, which shows a section taken on the line 12—12 of FIG. 1; the novel air suction pipe 120 of the air cleaner 9 is formed into an L-shape, extends along an upper part of the intake passage pipe 123 from an air inlet port 120*a* to a front side in a substantially horizontal direction, bends downward at the end of the front side; and its lower end outlet 120*b* connects to an outer space 128 adjacent the filter element 121 as illustrated by FIG. 11.

In FIG. 11, the element 121 is formed into a rectangular frame-work, and has an inside space 129 connected to the air intake passage pipe 123. 130 is a hole for receiving and passing the air cleaner body fitting bolt 124.

During operation of engine, new air sucked from the novel air intake port 120*a* of FIG. 12 flows into the space 128 outside the element 121 of FIG. 11 from the suction pipe 120, passes the filter element 121 to be cleaned thereby, and flows into the inside space 129. Then, the air flows through the air cleaner-side intake passage pipe 123 to the intake passage 111 of the cylinder head 7.

Figure 13:
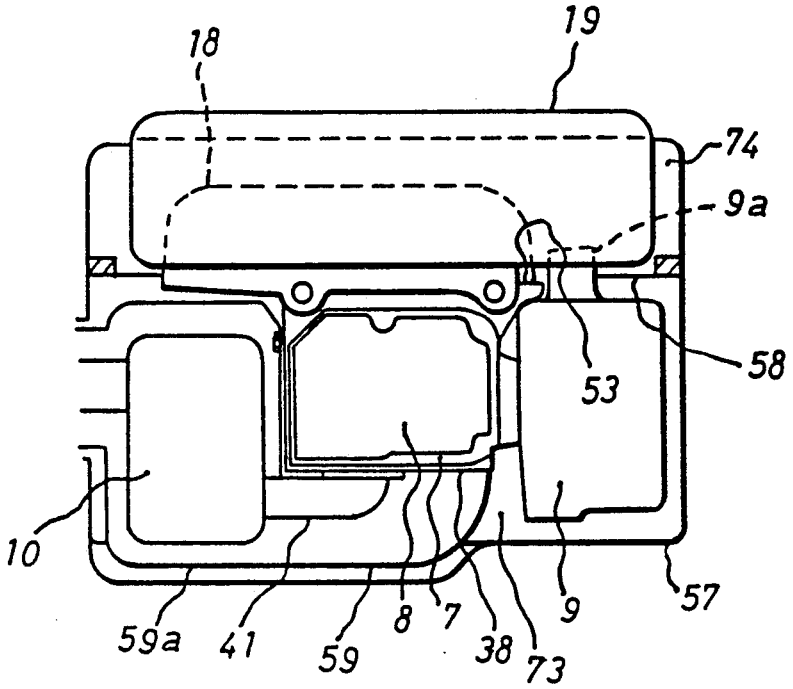
FIG. 13 is a horizontal sectional schematic view of a single package of an internal combustion engine equipped with an exhaust duct and a partition plate.

FIG. 13 illustrates a second embodiment wherein an air-cooled internal combustion engine is surrounded by a sound insulating cover 57. In this embodiment, a partition plate 58 is held between the fan case fitting surface 53 of the engine body and the fan case 18, so that a space internally of the sound insulating cover 57 is divided into a first chamber 73 located at the power take-out side of the partition plate 58 and a second chamber 74 located at the fan case side of the plate. The engine body, the exhaust muffler 10 and the air cleaner 9 are installed in the first chamber 73, and the fan case 18 and the fuel tank 19 located above it are installed in the second chamber 74. An exhaust air duct 59 is connected to the exhaust air flange 38 in order to induce exhaust air, which flows from the cylinder 2 and the cylinder head 7, collectively into a muffler cover 59*a* and then exhaust it to an outside of the sound insulating cover 57. The primary expansion chamber in combination with exhaust pipe 41 is housed in the exhaust air duct 59.

The first chamber 73 becomes hot due to heat radiation of the engine body, air exhausted from the exhaust pipe 41 and exhausted cooling air. On the other hand, the second chamber 74 divided by the partition plate 58 is kept at a low temperature. An air intake port 9*a* of the air cleaner 9 pierces the partition plate 58 to open to the second chamber 74 of low temperature, so that it can always intake cool new air to be useful for increase in an engine output.

Figure 14:
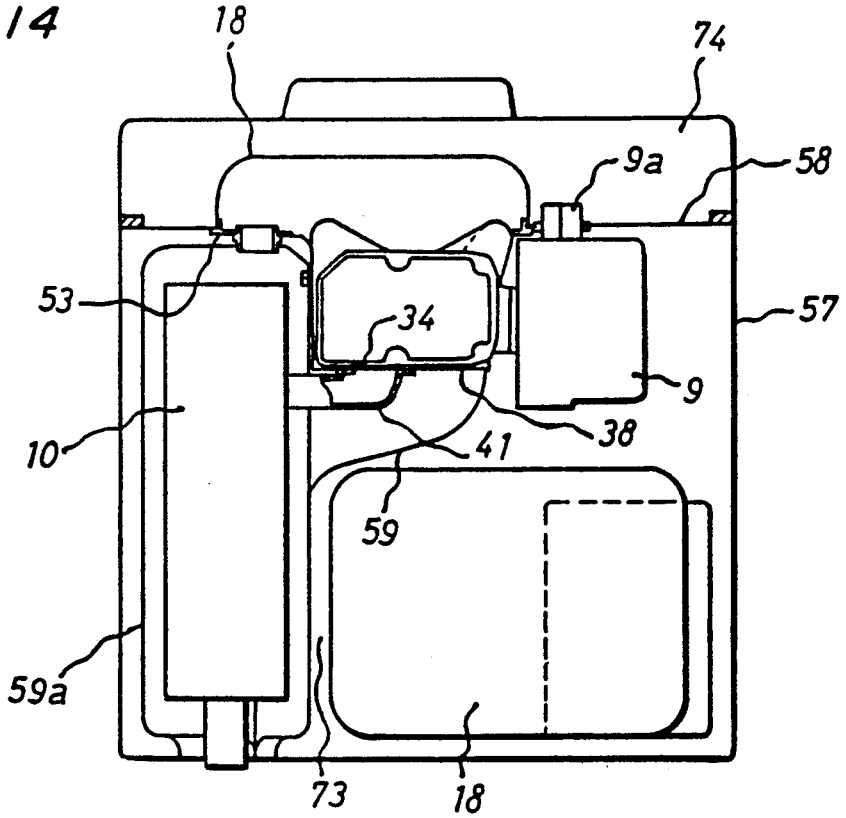
FIG. 14 is a horizontal sectional schematic view of an operation machine set equipped with an exhaust duct and a partition plate.

FIG. 14 illustrates a third embodiment of the internal combustion engine mounted for sound insulating operation of a machine such as a generator. The generator (not shown) and the internal combustion engine are both installed inside a sound insulating cover 57.

The partition plate 58 is held between the fan case fitting surface 53 of the engine body and the fan case 18, so that a space in the sound insulating cover 57 is divided into a first chamber 73 located at the power take-out side of the partition plate 58 and second chamber 74 located at the fan case side of the plate. The engine body, the horizontal exhaust muffler 10 having a large capacity, the air cleaner 9, an operating machine and the fuel tank 18 are installed in the first chamber 73. The fan case 18 is installed in the second chamber 74. The exhaust air duct 59 is connected to the exhaust air flange 38 in order to induce exhaust air, which flows from the cylinder 2 and the cylinder head 7, collectively into the muffler cover 59*a* and then exhaust it to outside of the sound insulating cover 57. The primary expansion chamber in combination with exhaust pipe 41 is housed in the exhaust air duct 59.

The first chamber 73 becomes hot due to heat radiation of the engine body, air exhausted from the exhaust pipe 41 and exhausted cooling air. On the other hand, the second chamber 74 divided by the partition plate 58 is kept at a low temperature. The air intake port 9*a* of the air cleaner 9 pierces the partition plate 58 to open to the second chamber 74 of low temperature, so that it can always intake cool new air to be useful for increasing the engine output.

According to the present invention as further defined by the claims, the cam shaft 14 and the balancing shaft 13 are installed on the air cleaner side of the crank shaft 12 and the starting motor 29 is installed on the exhaust muffler side thereof, the shaft portions of the balancing shaft 13 and the starting motor 29 are located at positions lower than the crank shaft 12, and a exhaust muffler 10 is horizontally arranged at the position above the starting motor 29; so that the center of gravity of the entire engine can be lowered, the engine can be stabilized, and vibration of the entire engine due to vibration of the starting motor can be controlled.

Further, the starting motor 29 is located at a relatively low position on the crankcase so the exhaust muffler 10 can be installed horizontally on the engine and the overall size and dimensions of the entire engine can be minimized.

According to a further embodiment of the invention, the cooling air exhausted from the cylinder head 7 and the cylinder 2 is collected to one spot and the exhaust air flange 38 is formed to surround the cylinder head 7 and cylinder 2, so that the exhaust air duct can be easily attached and the disposal of exhausted cooling air becomes simple when mounting the engine to operate a machine. Accordingly, noise reduction and simplification of the structure of the engine and operating machine set can be accomplished.

The exhausted cooling air can be collected to one spot and taken out of the operating machine area, so that the temperature of the operating machine can be kept low.

According to a further embodiment of the invention, the length of the exhaust port 34 of the cylinder head 7 can be shortened to a minimum and the exhaust can be expanded in a primary expansion chamber provided in combination with exhaust pipe 41 which has a large capacity immediately after exhaustion, so that the exhaust noise can be reduced.

Further, four sides of the cylinder 2 are surrounded by the fuel tank 19, the exhaust muffler 10, the primary expansion chamber in combination with exhaust pipe 41 and the air cleaner 9, so that the sound emitted from the cylinder head 7 and the cylinder 2 can be controlled.

According to a still further embodiment of the invention, the fuel injection valve 43 is housed in a fuel injection valve chamber 46 of the cylinder head cover 8, so that noise emitted from around the fuel injection nozzle can be cut off.

Further, a part of the cooling air of the cylinder head 7 is induced to the fuel injection valve chamber 46 in order to positively cool the fuel injection valve 43, so that the temperature of the fuel injection valve 43 can be effectively controlled.

According to a further embodiment, it is necessary to provide a vibration-proof means only on the upper end portion of the fuel tank 19 where the tank is mounted on the cylinder head 7, so that a vibration-proof mechanism for the fuel tank 19 becomes simple.

Further, noise emitted from the upper part of the fan case 18 can be cut off.

Moreover, a vibration absorbing member is fitted between the fuel tank 19 and the fan case 18 to control vibration and reduce noise from the fan case 18 and the fuel tank 19.

According to a further embodiment of the invention, the partition plate 58 can be installed easily in a sound insulating cover for the entire engine or the engine and an operating machine, so that the cool air in the sound insulating cover can be separated from the heated exhausted cooling air and hot air resulting from head radiation from the engine body.

Further, the air intake port 9*a* of the air cleaner 9 is opened to the cool chamber side through the partition plate 58, so that cool new air can always be taken in to improve engine output.

According to a further embodiment of the invention, the intake passage inlet 111*a* of the cylinder head 7 together with the fuel injection pump 112 are covered by the air cleaner 9, so that noises emitted from the area of the cylinder head and sound of the injection pump can be cut off within a short distance and various noises can be reduced.

Further, the capacity of the air cleaner 9 can be made large so that the intake noise can be further reduced.

The injection pump 112 is located at a position lower than the intake passage inlet 111*a* between the air cleaner 9 and the air cleaner fitting surface 14, so that the angle of the injection pump 112 in relation to the cylinder center line can be made small. Thereby, high-speed and high-load performances can be improved because the fuel pipe between the fuel injection valve 10 and the fuel injection pump 12 can be shortened.

According to a further arrangement of the invention, the novel air intake pipe 120 is formed as an integral part of the air cleaner body 116 adjacent to the air cleaner fitting surface 114 of the cylinder head 3, so that a service life of the air cleaner can be prolonged because it makes it more difficult to suck atmospheric air and dust. In addition, the novel air intake pipe 120 can be made long and thereby avoid emitting the suction noise outside, so that the emission of air intake suction noise can be effectively controlled and prevented.

The intake pipe 120 is provided between the cylinder head 7 and the air cleaner filter 121, so that the overall size and dimensions of the entire engine can be minimized.

What is claimed is:

1. An air-cooled internal combustion engine of the type which includes an exhaust muffler and an air cleaner arranged separately on the left and right sides of an engine body as viewed from a power take-out side in a longitudinal direction of a crank-shaft, a cooling fan and a fan case installed on a side opposite to a power take-out side, and a fuel tank installed at an upper part of the fan case; wherein the improvement comprises:

a cam shaft and a balancing shaft arranged on the air cleaner side in the engine body relative to the crank-shaft, a starting motor arranged on a side face of the engine body at the exhaust muffler side relative to the crank-shaft, the balancing shaft and a shaft portion of the starting motor are located at a position lower than the crank-shaft, and the exhaust muffler is arranged above the starting motor.

2. An air-cooled internal combustion engine of the type which includes an exhaust muffler and an air cleaner arranged separately on the left and right sides of an engine body as viewed from a power take-out side in a longitudinal direction of a crank-shaft, a cooling fan and a fan case installed on a side opposite to a power take-out side, and a fuel tank installed at an upper part of the fan case; wherein the improvement comprises:

a cooling air passage which enables cooling air to flow only from the cooling fan side to the power take-out side is formed in a cylinder head, a cooling air passage which enables cooling air to flow only from the cooling air side to the power take-out side is formed in a cylinder, an exhaust air flange is formed on the power take-out side cooling air outlets of the cylinder head and the cylinder and surrounds them, and means for guiding exhaust air is removably attached to the exhaust air flange.

3. An air-cooled internal combustion engine of the type which includes an exhaust muffler and an air cleaner arranged separately on the left and right sides of an engine body as viewed from a power take-out side in a longitudinal direction of a crank-shaft, a cooling fan and a fan case installed on a side opposite to a power take-out side, and a fuel tank installed at an upper part of the fan case; wherein the improvement comprises:

a cooling air passage which permits cooling air to flow from the cooling fan side of the engine to the power take-out side is formed in the cylinder head, a fuel injection valve chamber and a rocker arm chamber are integrally formed in a cylinder head cover fastened to an upper part of the cylindrical head, said fuel injection valve chamber is isolated from said rocker arm chamber, a cooling fan side end of the injection valve chamber is connected to an upstream side of the cooling air passage on the head-side of the engine through a cooling air intake port of a cylinder head upper wall, and a power take-out side end of the fuel injection valve chamber is connected to a downstream side of the head-side cooling air passage through a cooling air outlet port of the cylinder head upper wall.

4. An air-cooled internal combustion engine of the type which includes an exhaust muffler and an air cleaner arranged separately on the left and right sides of an engine body as viewed from a power take-out side in a longitudinal direction of a crank-shaft, a cooling fan and a fan case installed on a side opposite to a power take-out side, and a fuel tank installed at an upper part of the fan case; wherein the improvement comprises:

a fan case fitting surface fitting evenly over fitting planes of a cylinder and a crank-case, the exhaust muffler and the air cleaner are located at positions removed from the fan case fitting surface toward the power take-out side, and a partition plate between the fan case fitting surface and fan case flange of the engine body, whereby an engine space is partitioned into a fan case side space and a space which houses the engine body, the exhaust muffler and the air cleaner.

5. An air-cooled internal combustion engine, comprising:

an intake passage inlet located on one side of a cylinder head of the engine; a fuel injection pump arranged on the intake passage inlet side of the cylinder head of the engine; an air cleaner positioned to block viewing of the intake passage inlet from the intake passage inlet side of the engine; an intake passage outlet of the air cleaner is connected to the intake passage inlet of the cylinder head, and the fuel injection pump is located at a position lower than the intake passage inlet of the cylinder head and between the cylinder head and a body of the air cleaner.

6. An air-cooled internal combustion engine, comprising:

an air cleaner having a body mounted to an air cleaner fitting surface of a cylinder head of the engine by an intake passage pipe and an air suction pipe formed integrally with the air cleaner body adjacent to the air cleaner fitting surface of the cylinder head.

* * * * *